US007650174B2

(12) United States Patent
Aoki et al.

(10) Patent No.: US 7,650,174 B2
(45) Date of Patent: Jan. 19, 2010

(54) SUPERCONDUCTIVE FILTER CAPABLE OF EASILY ADJUSTING FILTER CHARACTERISTIC AND FILTER CHARACTERISTIC ADJUSTING METHOD

(75) Inventors: Tsuyoshi Aoki, Kawasaki (JP); Kazuaki Kurihara, Kawasaki (JP); Teru Nakanishi, Kawasaki (JP); Akihiko Akasegawa, Kawasaki (JP); Manabu Kai, Kawasaki (JP); Kazunori Yamanaka, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/594,778

(22) Filed: Nov. 9, 2006

(65) Prior Publication Data

US 2007/0210874 A1 Sep. 13, 2007

(30) Foreign Application Priority Data

Mar. 8, 2006 (JP) ..... 2006-062863
Sep. 28, 2006 (JP) ..... 2006-265292

(51) Int. Cl.
*H01P 1/203* (2006.01)
*H01B 12/02* (2006.01)

(52) U.S. Cl. ..... 505/210; 333/99 S; 333/205; 333/235

(58) Field of Classification Search ..... 333/99 S, 333/205, 235; 505/210
See application file for complete search history.

(56) References Cited

U.S. PATENT DOCUMENTS

| | | | | |
|---|---|---|---|---|
| 5,406,233 | A * | 4/1995 | Shih et al. | 333/161 |
| 6,516,208 | B1 * | 2/2003 | Eden | 505/210 |
| 6,522,217 | B1 * | 2/2003 | Shen | 333/99 S |
| 6,662,029 | B2 * | 12/2003 | Eden et al. | 505/210 |
| 2005/0256010 | A1 * | 11/2005 | Nakanishi et al. | 505/210 |

FOREIGN PATENT DOCUMENTS

| | | |
|---|---|---|
| JP | 10-209722 | 8/1998 |
| JP | 2004-64359 | 2/2004 |
| JP | 2005-354657 | 12/2005 |

* cited by examiner

*Primary Examiner*—Benny Lee
(74) *Attorney, Agent, or Firm*—Fujitsu Patent Center

(57) ABSTRACT

A resonator pattern made of superconductive material is disposed over a first surface of a base substrate made of dielectric. An adjustment substrate made of dielectric is disposed facing the first surface at a distance from the first surface. The adjustment substrate is supported by a support mechanism for supporting the adjustment substrate in such a manner capable of changing an angle between the first surface and a surface of the adjustment substrate facing the base substrate. A superconductive filter is provided which can shift a center frequency of a filter band and suppress disturbance of a waveform of a filter characteristic, with a simple method.

9 Claims, 13 Drawing Sheets

SUPERCONDUCTIVE FILTER CAPABLE OF EASILY ADJUSTING FILTER CHARACTERISTIC AND FILTER CHARACTERISTIC ADJUSTING METHOD

CROSS REFERENCE TO RELATED APPLICATION

This application is based on and claims priority of Japanese Patent Application No. 2006-265292 filed on Sep. 28, 2006, the entire contents of which are incorporated herein by reference.

BACKGROUND OF THE INVENTION

A) Field of the Invention

The present invention relates to a superconductive filter and a filter characteristic adjusting method, and more particularly to a superconductive filter and a filter characteristic adjusting method, capable of changing a filter bandwidth without changing the shape of resonator patterns formed on a dielectric substrate.

B) Description of the Related Art

A recent spread of mobile phones has made it essential to use high speed and large capacity transmission technologies. A superconductor has a very small surface resistance even in a high frequency area, as compared to a general electric conductor. Therefore, the superconductor is suitable for the material of a conductive pattern of a planar circuit type filter. The discovery of high temperature oxide superconductors and the development of refrigerators have greatly mitigated an issue of cooling a superconductor.

JP-A-HEI-10-209722 discloses a technique of adjusting impedance by forming a dielectric film on a strip line made of superconductive material or trimming a width of the strip line. JP-A-2004-64359 discloses a technique of changing a filter band-pass characteristic by controlling temperature of a superconductive filter. JP-A-2005-354657 discloses a technique of adjusting a filter characteristic by moving up or down an adjustment plate made of a normal conductor or a superconductor and disposed above a superconductive filter pattern.

JP-A-2002-204102 discloses a technique of adjusting a filter characteristic by moving up or down a dielectric plate disposed above a superconductive filter pattern by using a piezoelectric actuator. A superconductive filter disclosed in JP-A-2002-57506 is constituted of a plurality of half wavelength hair pin type patterns disposed along a straight line generally at an equal pitch. Each hair pin type pattern is slid transversally by a piezoelectric actuator to adjust a coupling coefficient of respective stages.

SUMMARY OF THE INVENTION

With the method disclosed in JP-A-HEI-10-209722, the dielectric film is formed on the strip line or the width of the strip line is trimmed. It is therefore necessary to add a dielectric film forming process and a laser abrasion process. The method disclosed in JP-A-2004-64359 requires a temperature adjusting apparatus.

The methods disclosed in JP-A-2005-354657 and JP-A-2002-204102 can change the center frequency of a passband width simply by moving up or down the adjustment plate. However, there is a case in which the waveform of a filter characteristic varies from an ideal waveform as the center frequency is shifted.

The method disclosed in JP-A-2002-57506 can adjust the characteristic of a filter having hair pin type patterns coupled at multiple stages. This method cannot be applied to a filter having other structures.

It is an object of the present invention to provide a superconductive filter capable of shifting the center frequency of a filter bandwidth while suppressing disturbance of the waveform of a filter characteristic. It is another object of the present invention to provide a filter characteristic adjusting method capable of shifting the center frequency of a filter bandwidth while suppressing disturbance of the waveform of a filter characteristic.

According to one aspect of the present invention, there is provided a superconductive filter comprising:

a base substrate made of dielectric;

a resonator pattern made of superconductive material and formed over a first surface of the base substrate;

an adjustment substrate made of dielectric and disposed facing the first surface at a distance from the first surface; and a support mechanism for supporting the adjustment substrate in such a manner capable of changing an angle between the first surface and a surface of the adjustment substrate facing the base substrate.

According to another aspect of the present invention, there is provided a method of adjusting filter characteristic of a superconductive filter comprising:

a base substrate made of dielectric;

a resonator pattern made of superconductive material and formed over a first surface of the base substrate; and an adjustment substrate made of dielectric and disposed facing the first surface at a distance from the first surface, wherein the method comprises a step of:

changing an attitude of the adjustment substrate with reference to the first surface of the base substrate.

The filter characteristic can be adjusted by changing an angle between the first surface and a surface of the adjustment substrate facing the base substrate.

DETAILED DESCRIPTION OF THE PREFERRED EMBODIMENTS

It must be noted that like features depicted in the different drawing figures are designated by the same reference numbers and may not be described in detail for all drawing figures in which they appear.

Figure 1A:
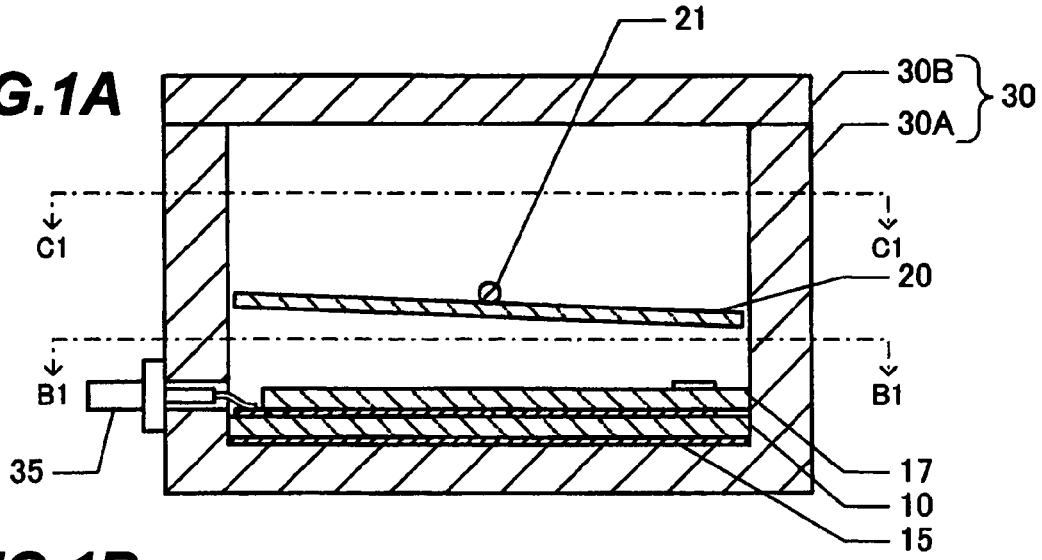
FIGS. 1A to 1C are cross sectional views of a superconductive filter according to a first embodiment.
Figure 1B:
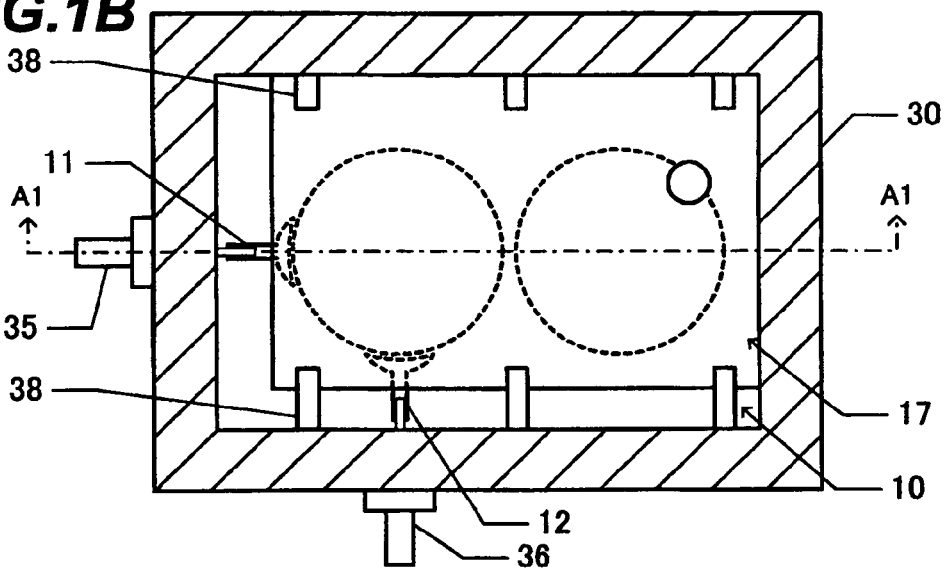
Figure 1C:
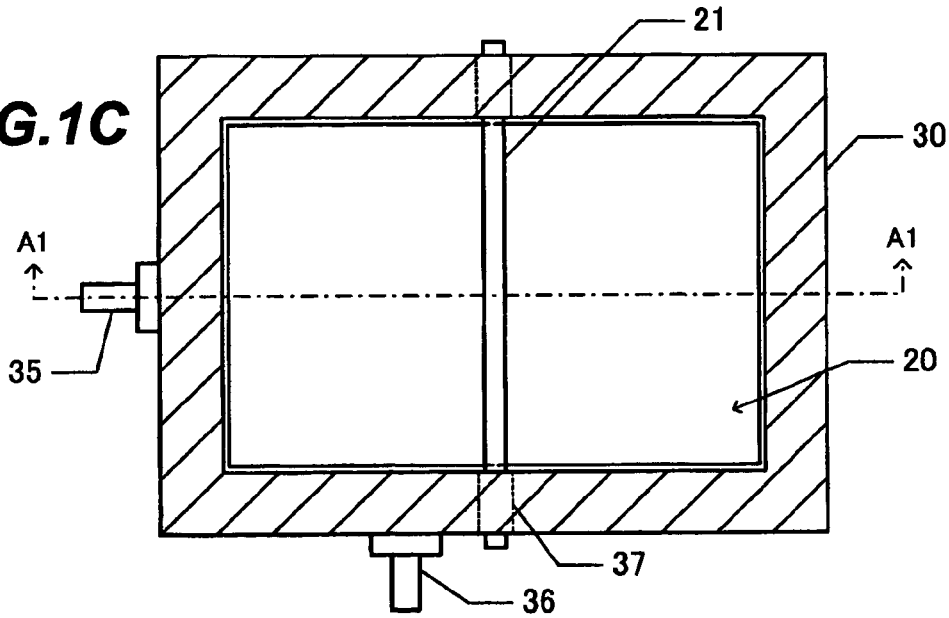

FIG. 1A is a cross sectional view of a superconductive filter according to the first embodiment. FIGS. 1B and 1C are a cross sectional view taken along one-dot chain line B1-B1 shown in FIG. 1A and a cross sectional view taken along one-dot chain line C1-C1 shown in FIG. 1A, respectively. A cross sectional view taken along one-dot chain lines A1-A1 shown in FIGS. 1B and 1C corresponds to FIG. 1A.

A base substrate 10 (FIGS. 1A, 1B) is disposed on the bottom of a main body 30A (FIG. 1A) of a package 30. Resonator patterns are formed on the front surface of the base substrate 10 and a ground film 15 (FIG. 1A) is formed on the back surface. The ground film 15 contacts the bottom of the package main body 30A. An additional substrate 17 (FIGS. 1A, 1B) is disposed on the base substrate 10.

The package main body 30A is a container having a cuboid shape whose top is opened. This opening is closed by a ceiling plate 30B (FIG. 1A). The package main body 30A and ceiling plate 30B constitute the package 30 defining an inner closed space. The package 30 is made of oxygen free copper. Instead of oxygen free copper, the package may be made of pure aluminum, aluminum alloy, copper alloy or the like. The package may be made of KOVAR, INVAR, 42-Alloy or the like having a thermal contraction coefficient near to that of the base substrate 10.

Figure 2A:
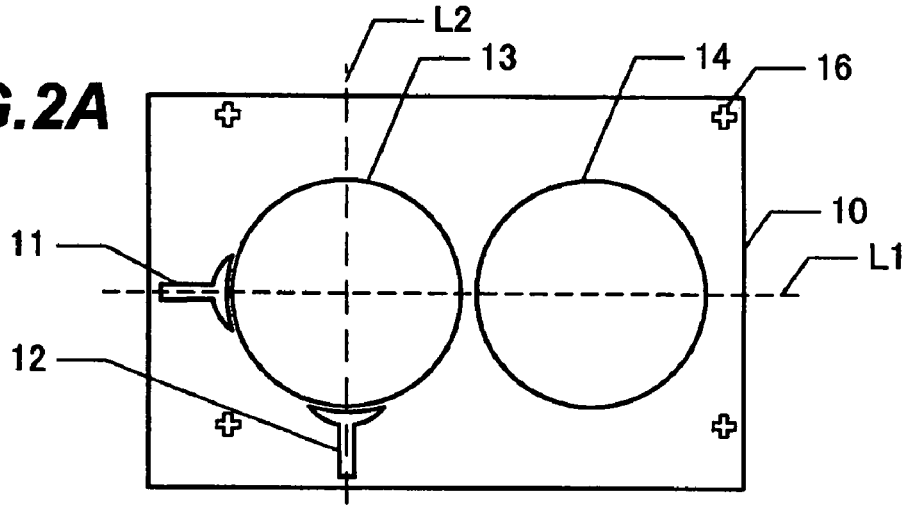
FIG. 2A is a plan view of a base substrate of the superconductive filter of the first embodiment.

FIG. 2A is a plan view of the base substrate 10. The base substrate 10 is made of dielectric such as single crystal MgO, has a rectangle plan shape with a longer side length of 36 mm and a shorter side length of 22 mm, and has a thickness of 0.5 mm. Resonator patterns 13 and 14 having a circular shape with a diameter of about 12.8 mm and a thickness of 500 nm are formed on the surface of the base substrate 10, being arranged parallel to the longer side. Signal input/output feeders 11 and 12 are coupled to the resonator pattern 13. A line width of each of the feeders 11 and 12 is 0.5 mm and the width of an end portion of each of the feeders 11 and 12 facing the resonator pattern 13 is broadened. The feeder 11 is disposed along a first virtual straight line L1 passing through the centers of the resonator patterns 13 and 14. The other feeder 12 is disposed along a second virtual straight line L2 crossing the first virtual straight line L1 at a right angle and passing through the center of the resonator pattern 13. Position alignment marks 16 are formed on the surface of the base substrate 10 at predetermined positions.

These patterns are made of Y—Ba—Cu—O based superconductive material (hereinafter, represented by YBCO). The patterns may be made of oxide superconductive material other than YBCO, for example, R—Ba—Cu—O based material (R is Nb, Ym, Sm or Ho), Bi—Sr—Ca—Cu—O based material, Pb—Bi—Sr—Ca—Cu—O based material and $CuBa_pCa_qCu_rO_x$ based material ($1.5<p<2.5$, $2.5<q<3.5$, $3.5<r<4.5$) or the like. The ground film 15 is formed on the whole back surface of the base substrate 10 as illustrated in FIG. 1A.

In the following, description will be made on a manufacture method for the base substrate 10, resonator patterns 13 and 14, feeders 11 and 12 and ground film 15.

First, a film of YBCO is formed on both surfaces of a single crystal MgO substrate having a diameter of 2 inches (50.8 mm) and a thickness of 0.5 mm, by laser vapor deposition. The YBCO film on one surface is patterned by usual photolithography techniques to form the resonator patterns 13 and 14, feeders 11 and 12 and position alignment marks 16. An electrode is formed on the surface of the end portion of each of the feeders 11 and 12 on the side opposite to the resonator pattern 13, by a lift-off method. The electrode is made of a lamination of a Cr film, a Pd film and an Au film laminated in this order. Ag is vapor-deposited on the whole surface of the YBCO film formed on the opposite surface (back surface). Lastly, the MgO substrate is cut into a predetermined size with a dicing saw.

Figure 2B:
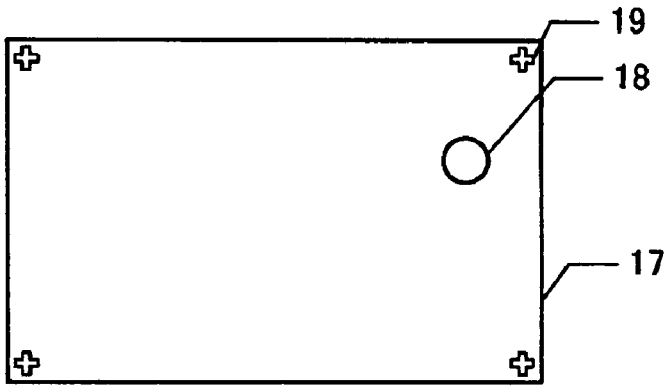
FIG. 2B is a plan view of an additional substrate.

FIG. 2B is a plan view of the additional substrate 17. The additional substrate 17 is made of dielectric such as $LaAlO_3$, has a rectangle plan shape with a longer side length of 33 mm and a shorter side length of 20 mm, and has a thickness of 0.5 mm. Namely, the additional substrate 17 is slightly smaller than the base substrate 10. An additional pattern 18 is formed on the surface of the additional substrate 17, having a diameter of about 2.8 mm and a thickness of 500 nm. Position alignment marks 19 are formed at predetermined positions. These patterns are made of superconductive material such as YBCO.

Next, description will be made on a manufacture method for the additional substrate 17 and additional pattern 18.

First, a YBCO film having a thickness of 500 nm is formed on one surface of a $LaAlO_3$ substrate having a diameter of 2 inches (50.8 mm) and a thickness of 0.5 mm. The YBCO film is patterned by usual photolithography techniques to form the additional pattern 18 and position alignment marks 19. Lastly, the substrate is cut into a predetermined size with a dicing saw.

Figure 2C:
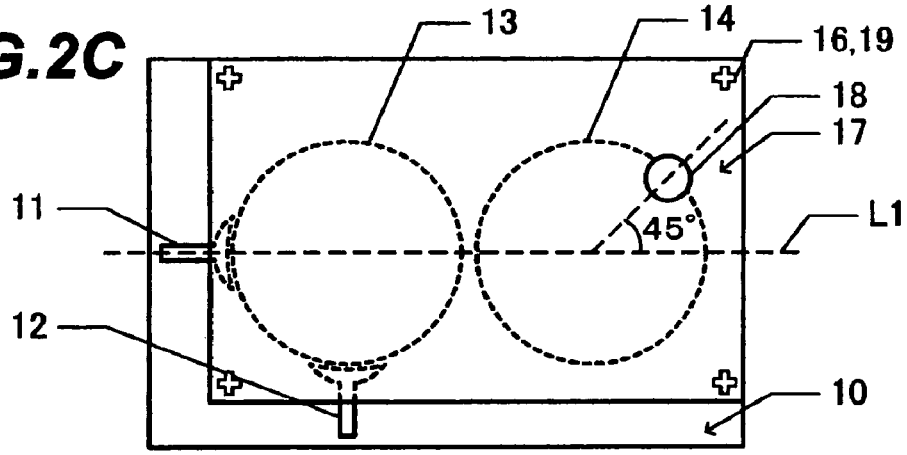
FIG. 2C is a plan view of the base substrate and the additional substrate stacked on the base substrate.

FIG. 2C is a plan view showing the base substrate 10 and additional substrate 17 stacked on the base substrate 10. These two substrates are aligned in position by superposing the position alignment marks 16 formed on the base substrate 10 upon the position alignment marks 19 formed on the additional substrate 17. In this state, the additional pattern 18 is superposed upon the outer circumferential line of the resonator pattern 14 at a position spaced from the first virtual straight line L1. For example, the additional pattern 18 is disposed at a cross point between a straight line extending from the center of the resonator pattern 14 at 45 degrees to the first virtual straight line L1 and the outer circumferential line of the resonator pattern 14. The end portions of the feeders 1 and 12 are not in contact with the additional substrate 17, but are exposed.

Description will continue reverting to FIGS. 1A to 1C. The base substrate 10 and additional substrate 17 are loaded in the package main body 30A in the state maintaining the positional relation shown in FIG. 2C. The positions of the base substrate 10 and additional substrate 17 are fixed by retainer springs 38 (FIG. 1B). The surface of the package main body 30A is plated with gold.

An adjustment substrate 20 (FIGS. 1A, 1C) is disposed above the additional substrate 17. The adjustment substrate 20 is made of dielectric such as LaAlO3, has a rectangle plan shape with a longer side length of 36 mm and a shorter side length of 22 mm, and has a thickness of 0.5 mm. Namely, the adjustment substrate 20 has the same size as that of the base substrate 10.

The adjustment substrate 20 is supported by the package main body 30A via a support shaft 21 (FIGS. 1A, 1C), facing the additional substrate 17. The support shaft 21 is made of dielectric having a dielectric constant lower than that of the adjustment substrate 20. The support shaft 21 is disposed crossing the longer sides of the adjustment substrate 20 at a right angle and passing through the centers of the longer sides, and fixed to the surface of the adjustment substrate 20 on the side opposite to the surface facing the additional substrate 17.

The support shaft 21 protrudes to the outside of the package main body 30A via through holes 37 (FIG. 1C) formed in the wall of the package main body 30A. As the support shaft 21 is rotated, the attitude of the adjustment substrate 20 changes in a way of changing an angle between the surface of the adjustment substrate 20 facing the additional substrate 17 and the surface of the base substrate 10.

An input connector 35 and an output connector 36 (FIGS. 1B, 1C) are mounted on the sidewalls of the package main body 30A. A center conductor of the input connector 35 and a center conductor of the output connector 36 are connected to the feeders 11 and 12, respectively, as illustrated in FIG. 1B, via Au wires having a diameter of 25 μm. An Au ribbon or an Al wire may be used instead of the Au wire. They may be connected to the feeders 11 and 12 by bonding or using solder.

As illustrated in FIG. 2A, in the superconductive filter of the first embodiment, the resonator pattern 13 constitutes a first stage disc type resonator, and the other resonator pattern 14 constitutes a second stage disc type resonator. The additional pattern 18 superposed upon the outer circumferential line of the resonator pattern 14 releases degeneracy of electromagnetic field modes perpendicular to each other. In the result, resonance frequencies are separated and the superconductive filter operates as a dual mode filter.

The center frequency and a degree of interference between electromagnetic field modes perpendicular to each other (coupling), i.e., a bandwidth depend on a mutual positional relation between the resonance pattern 14 and additional pattern 18. For example, as the additional pattern 18 moves toward the outside of the resonator pattern 14, coupling becomes strong and the bandwidth becomes broad. Conversely, as the additional pattern 18 moves toward the inside of the resonator pattern 14, coupling becomes weak and the bandwidth becomes narrow. In order to realize resonance in the dual mode, the additional pattern 18 and resonator pattern 14 are required not to place in a concentric fashion.

The superconductive filter of the first embodiment has a target center frequency of 4 GHz and a target bandwidth of 0.08 GHz.

Next, with reference to FIGS. 3A, 3B; 4A, 4B; 5A, 5B, description will be made on a function of the adjustment substrate 20 of the superconductive filter of the first embodiment.

Figure 3A:
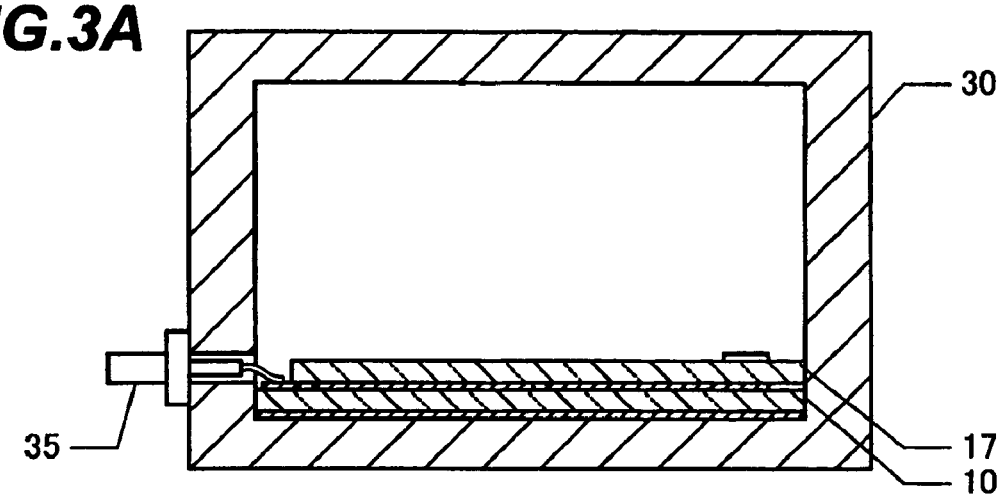
FIG. 3A is a cross sectional view of a superconductive filter according to a first reference example.

FIG. 3A is a cross sectional view of a superconductive filter in which an adjustment substrate 20 is not provided therein. This superconductive filter has the same structure as that of the superconductive filter of the first embodiment, excepting that the adjustment substrate 20 is not disposed.

Figure 3B:
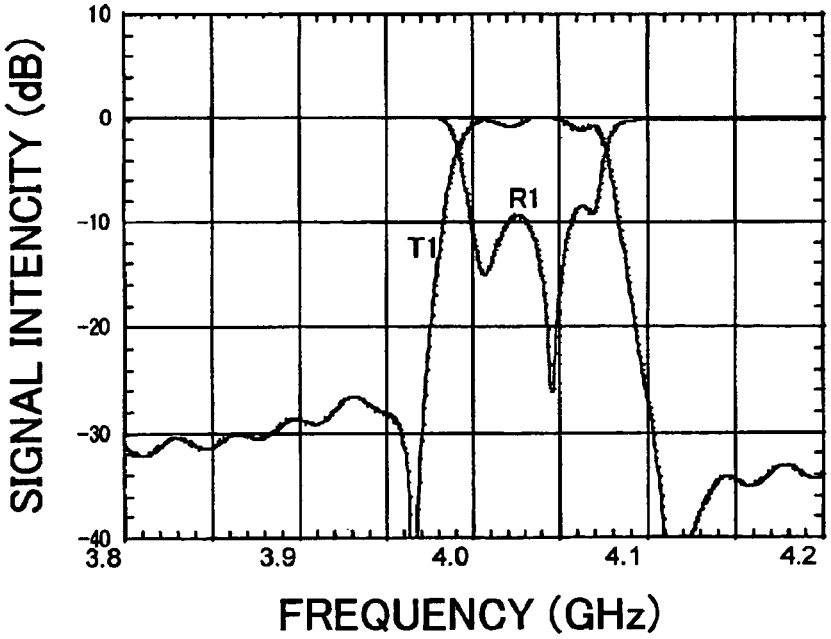
FIG. 3B is a graph showing transmission and reflection characteristics of the filter.

FIG. 3B shows transmission and reflection characteristics of the superconductive filter shown in FIG. 3A. The characteristics were measured under the condition that the superconductive filter was cooled to 70 K. The abscissa represents a frequency in the unit of "GHz" and the ordinate represents signal intensity in the unit of "dB". This relation is also applied to the graphs shown in FIGS. 4B and 5B to be described later. Curves T1 and R1 shown in FIG. 3B represent intensities of transmission and reflection waves, respectively. As seen from FIG. 3B, the center frequency is about 4.03 GHz shifted by about 0.03 GHz from the target center frequency.

Figure 4A:
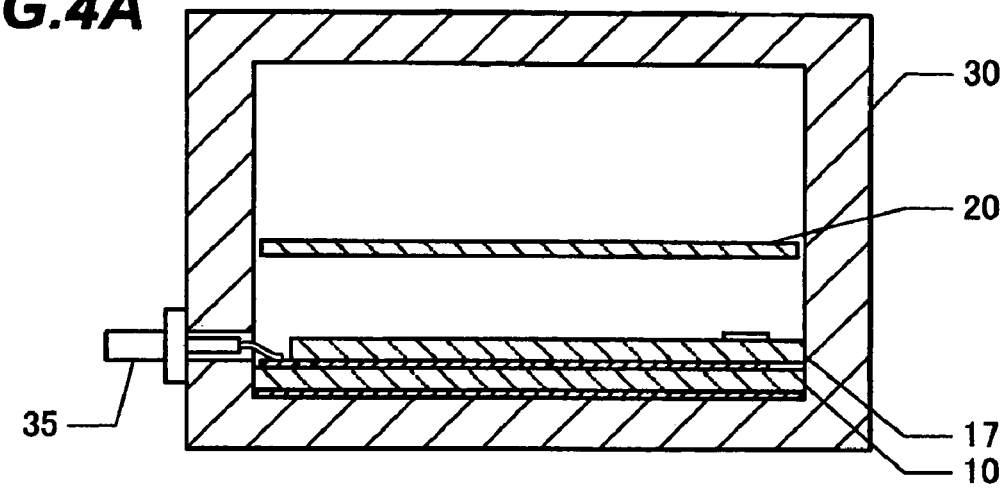
FIG. 4A is a cross sectional view of a superconductive filter according to a second reference example.

FIG. 4A is a cross sectional view of a superconductive filter in which the adjustment substrate 20 is disposed in parallel to the surface of the base substrate 10. A height from the upper surface of the additional substrate 17 to the adjustment substrate 20 was set to 3.5 mm.

Figure 4B:
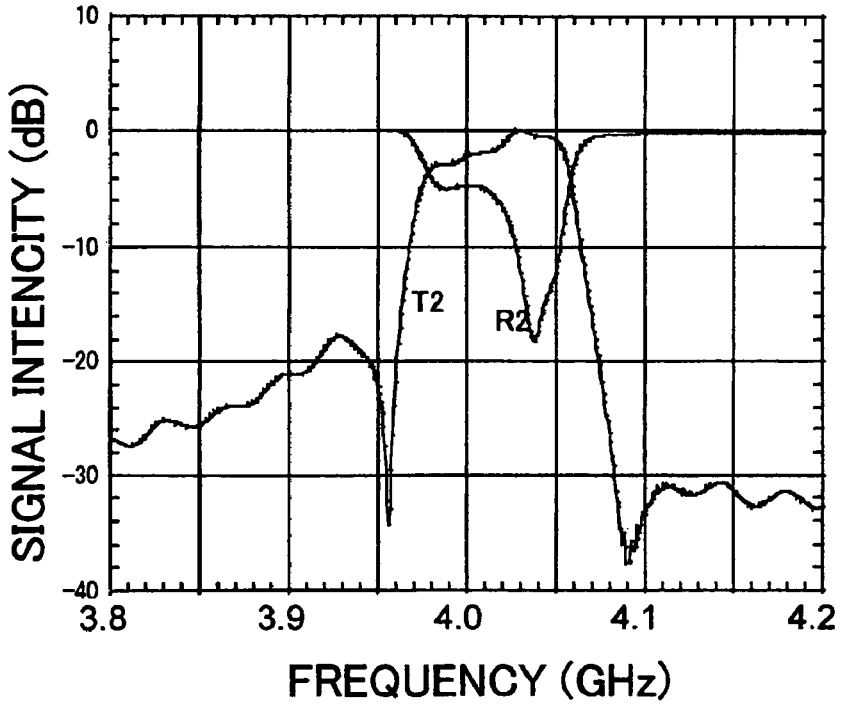
FIG. 4B is a graph showing transmission and reflection characteristics of the filter.

FIG. 4B shows transmission and reflection characteristics of the superconductive filter shown in FIG. 4A. Curves T2 and R2 shown in FIG. 4B represent intensities of transmission and reflection waves, respectively. The center frequency lowers slightly and comes close to the target center frequency. However, waveforms of the transmission and reflection characteristics are distorted and symmetry thereof is lost.

Figure 5A:
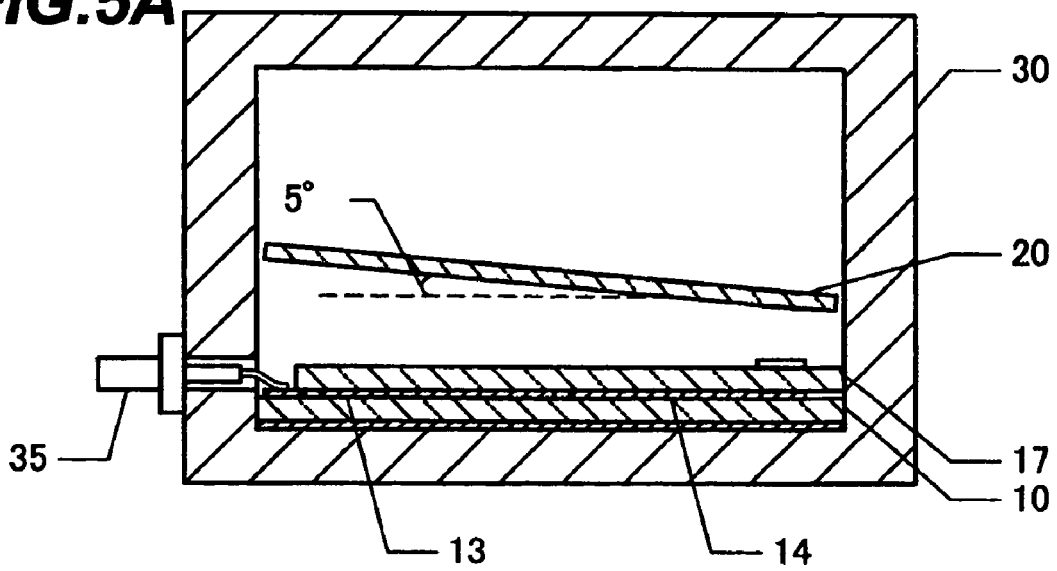
FIG. 5A is a cross sectional view of the superconductive filter of the first embodiment.

FIG. 5A is a cross sectional view of the superconductive filter of the first embodiment in which the adjustment substrate 20 is slanted by 5° to raise the edge on the side of the first stage resonator pattern 13. A height from the upper surface of the additional substrate 17 to the center of the adjustment substrate 20 was set to 3.5 mm.

Figure 5B:
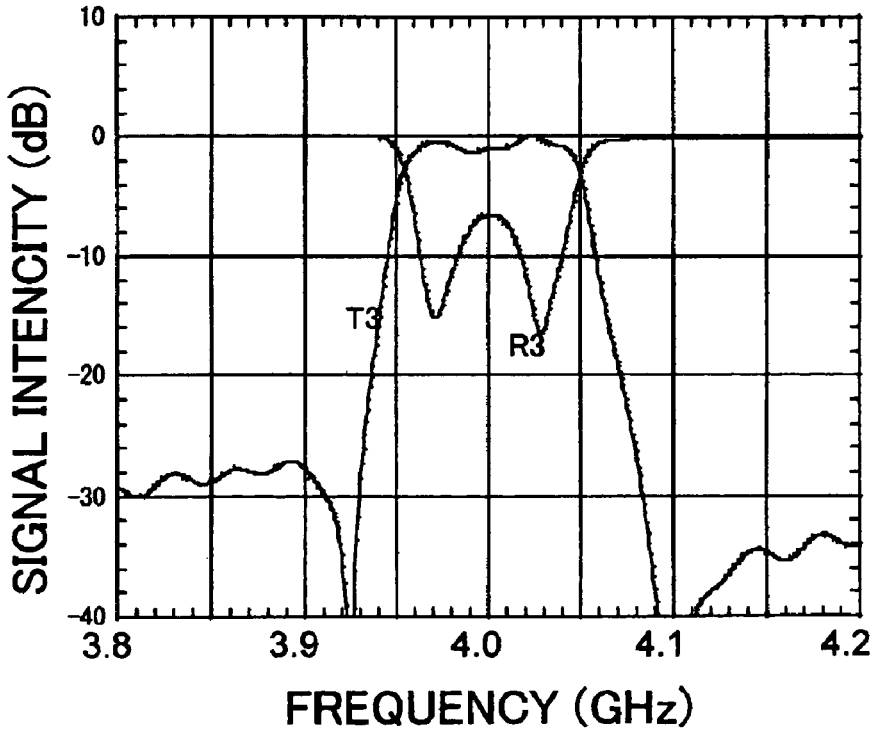
FIG. 5B is a graph showing transmission and reflection characteristics of the filter.

FIG. 5B shows transmission and reflection characteristics of the superconductive filter shown in FIG. 5A. Curves T3 and R3 shown in FIG. 5B represent intensities of transmission and reflection waves, respectively. The center frequency is nearly the target center frequency of 4 GHz. The waveforms of the transmission and reflection characteristics are almost symmetric.

The center frequency can be shifted by disposing the adjustment substrate 20 in parallel to the base substrate 10 and additional substrate 17 and adjusting a distance between the adjustment substrate 20 and additional substrate 17. However, if the distance is only adjusted without changing the attitude of the adjustment substrate 20, the waveforms of the transmission and reflection characteristics are distorted as shown in FIG. 4B. By changing the attitude of the adjustment substrate 20, the center frequency can be shifted while suppressing distortion of the waveforms.

Figure 6A:
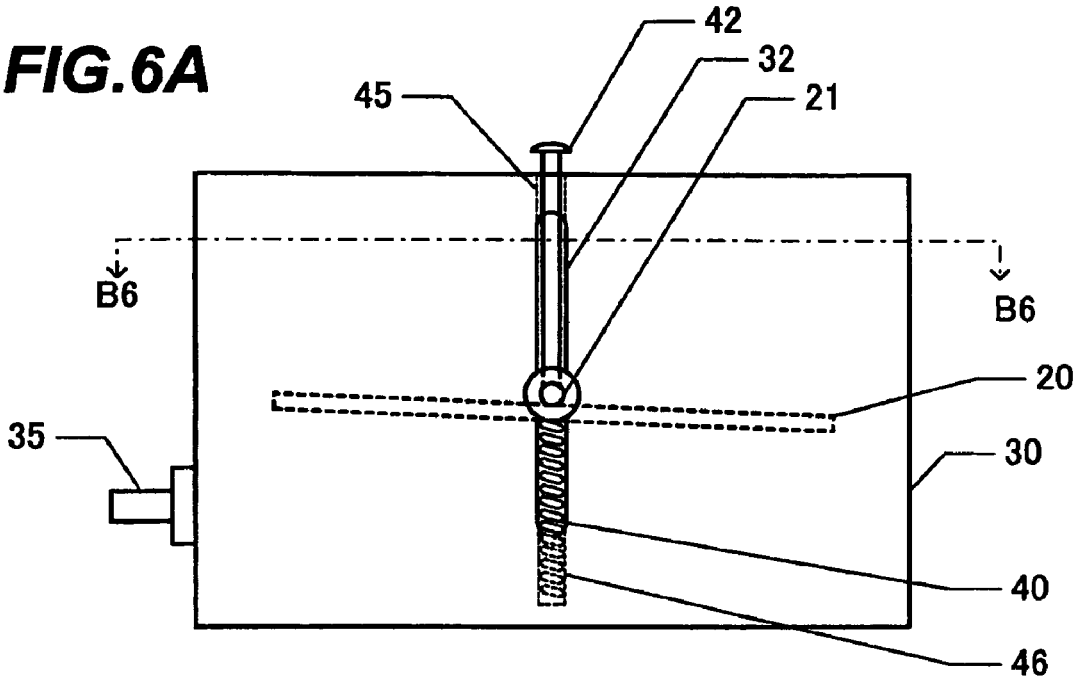
FIG. 6A is a front view of a superconductive filter according to a second embodiment.
Figure 6B:
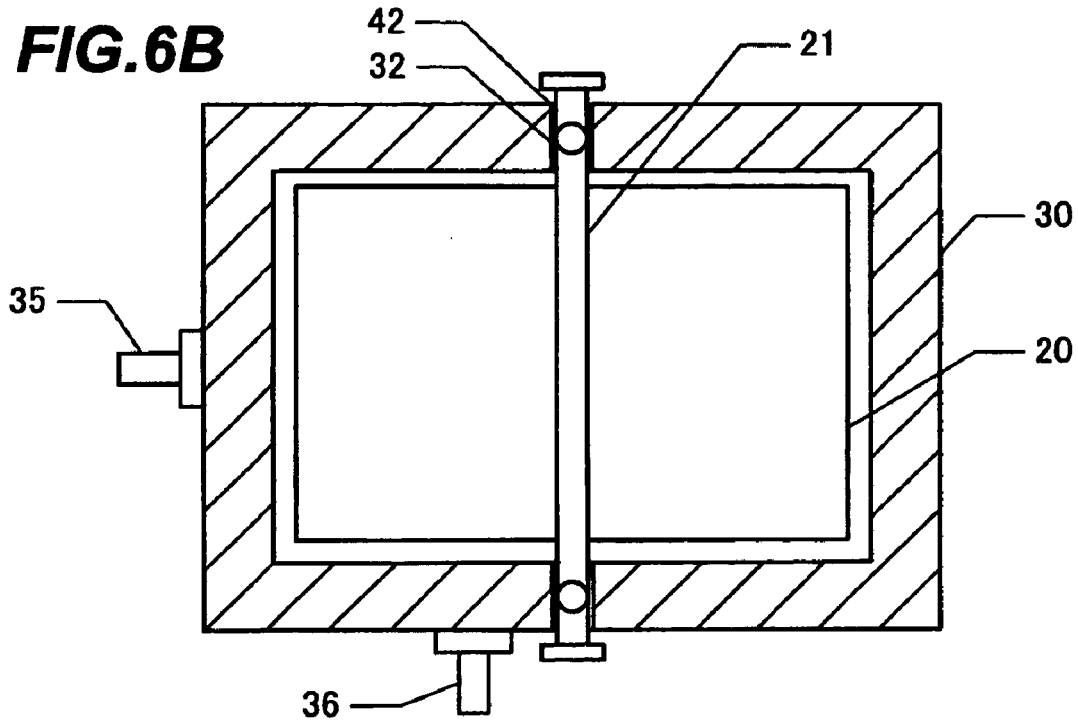
FIG. 6B is a cross sectional view thereof.

FIG. 6A is a front view of a superconductive filter according to the second embodiment, and FIG. 6B is a cross sectional view taken along one-dot chain line B6-B6 shown in FIG. 6A. Description will be made by paying attention to different points from the superconductive filter of the first embodiment shown in FIGS. 1A, 1B, 1C; 2A, 2B, 2C, and it is omitted to describe the components having the same structure as that of the superconductive filter of the first embodiment.

Slits 32 are formed in a pair of sidewalls of the package 30, and the support shaft 21 protrudes to the outside of the package 30 via the slits 32. The inner circumferential surface of each slit 32 includes a guide surface extending along a direction perpendicular to the surface of the base substrate 10. The support shaft 21 is guided by the guide surfaces and can move along a direction (up/down direction) with respect to a height from the base substrate 10 to the support shaft 21.

In the sidewalls of the package 30, through holes 45 (FIG. 6A) extending from the upper ends of the slits 32 to the upper surfaces of the package 30 are formed, and recesses 46 having bottoms and extending from the lower ends of the slits 32 to some depth are formed. A part of a coil spring 40 is inserted into the recess 46 and a remaining part thereof is disposed in the slit 32 to support the support shaft 21. An adjusting screw 42 is inserted into the through hole 45 and a top end of the adjusting screw contacts the support shaft 21 in the slit 32. By adjusting an insertion depth of the adjusting screw 42, a height to the end of the support shaft 21 can be changed. The adjustment substrate 20 can be tilted by setting opposite ends of the support shaft 21 to different heights.

In the second embodiment, a height to the adjustment substrate 20 can be adjusted by maintaining the attitude thereof unchanged. Further, the adjustment substrate 20 can be tilted not only in one direction but also in mutually perpendicular two directions. It is therefore possible to increase the degree of freedom of adjusting the center frequency and bandwidth of the superconductive filter.

Figure 7:
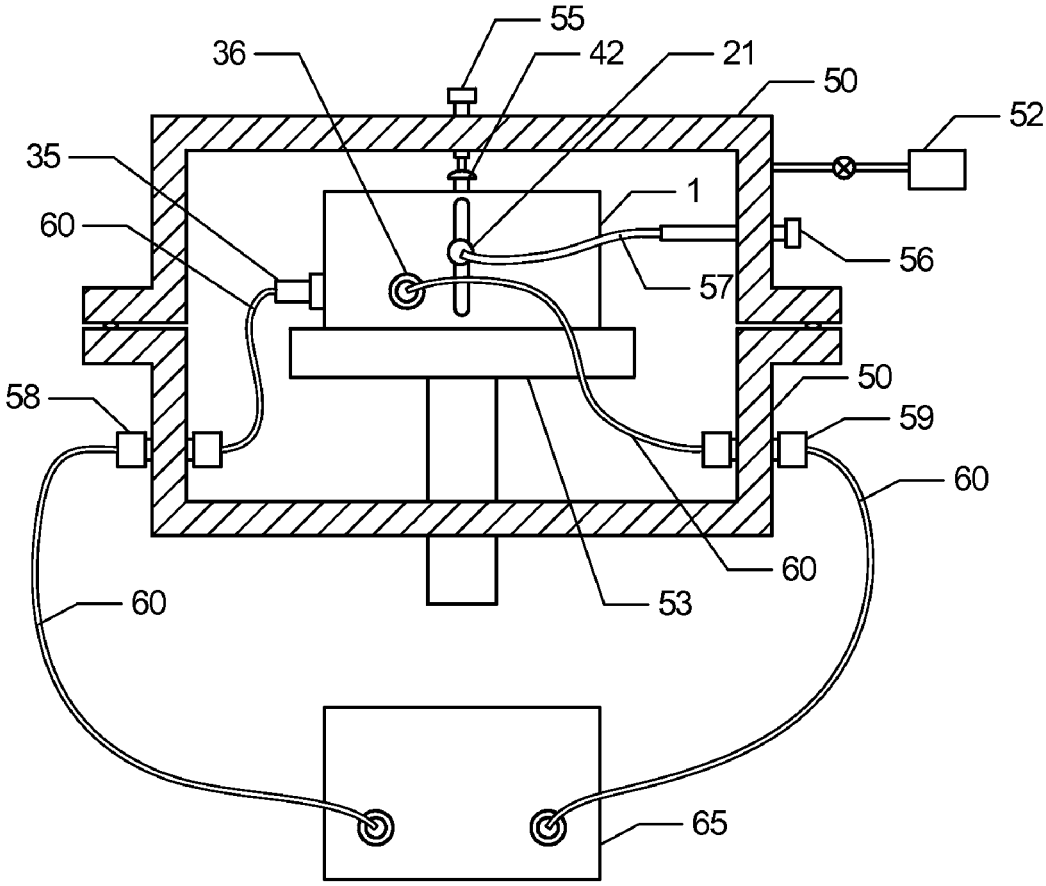
FIG. 7 is a cross sectional view of an adjusting apparatus for a superconductive filter.

FIG. 7 is a cross sectional view of an adjusting apparatus for the superconductive filters of the first and second embodiments. A superconductive filter 1 is accommodated in an adiabatic vacuum container 50. The adiabatic vacuum container 50 includes a lower container having an upper opening and an upper container having a lower opening. By abutting the openings of both the containers upon each other, a tightly air-shielded space can be defined. By involving an O ring between both the containers, an inner vacuum degree can be maintained.

The superconductive filter 1 is held on a cold plate 53 disposed in the adiabatic vacuum container 50. The cold plate 53 is thermally coupled to a cold head of a refrigerator, and cooled to a temperature at which the superconductive filter takes a superconductive phase. A vacuum pump 52 evacuates the inside of the adiabatic vacuum container 50.

Connectors 58 and 59 are mounted in the wall of the adiabatic vacuum container 50. The input connector 35 of the superconductive filter 1 is coupled to a network analyzer 65 via a coaxial cable 60 in the container, the connector 58 and a coaxial cable 60 outside the container. The output connector 36 of the superconductive filter 1 is coupled to the network analyzer 65 via a coaxial cable 60 in the container, the connector 59 and a coaxial cable 60 outside the container.

A height adjusting driver 55 passes through the upper wall of the adiabatic vacuum container 50 and is inserted into the container. The distal end of the driver is meshed with the adjusting screw 42 of the superconductive filter 1. An attitude adjusting driver 56 passes through the sidewall of the adiabatic vacuum container 50 and is inserted into the container. The distal end of the driver couples the end of the support shaft 21 via a flexible coupling tube 57.

A height to the end of the support shaft 21 can be changed by adjusting an insertion depth of the adjusting screw 42 by using the height adjusting driver 55. The attitude of the adjustment substrate 20 (e.g. see FIG. 1A) can be changed by rotating the support shaft 21 using the attitude adjusting driver 56.

Desired filter characteristics can be obtained by adjusting the height to the adjustment substrate 20 and the attitude of the adjustment substrate 20 using the height adjusting driver 55 and attitude adjusting driver 56 while the center frequency and the waveforms of the transmission and reflection characteristics of the superconductive filter 1 are observed with the network analyzer 65.

Figure 8A:
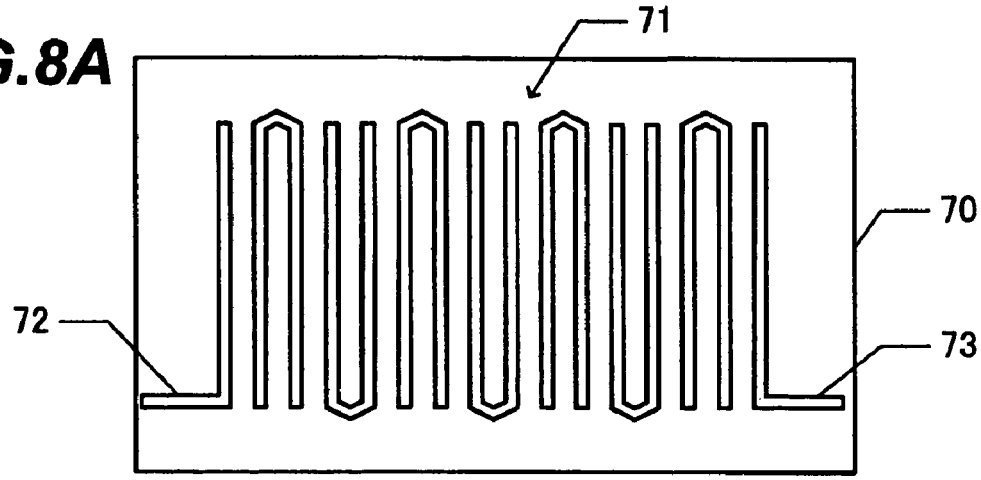
FIGS. 8A to 8C are plan views showing other examples of the structure of a resonator pattern.
Figure 8B:
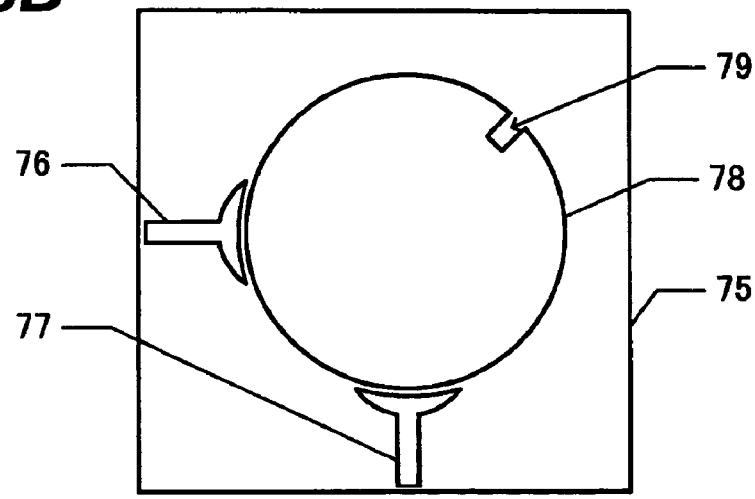
Figure 8C:
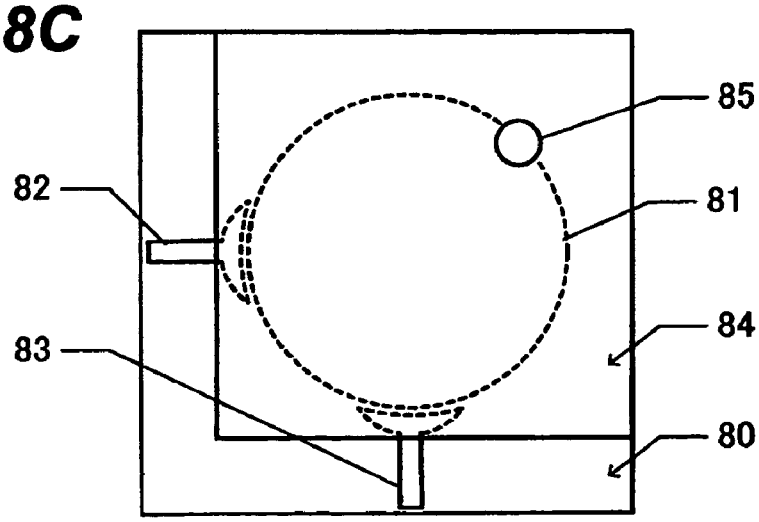

FIGS. 8A to 8C show other examples of the structure of the resonator pattern.

In the example of the structure shown in FIG. 8A, a hair pin type filter pattern 71 is formed on the surface of a base substrate 70. Feeders 72 and 73 are coupled to opposite ends of the hair pin type filter pattern.

In the example of the structure shown in FIG. 8B, a circular resonator pattern 78 is formed on the surface of a base substrate 75, the pattern having a notch 79. Feeders 76 and 77 are coupled to the resonator pattern 78. The feeders 76 and 77 are disposed respectively on lines extending from a pair of radii constituting a sector having a center angle of 90°. The notch 79 is disposed at a position facing the feeders 76 and 77 across the center of the resonator pattern 78. Since the notch 79 is formed, dual mode resonances are generated in the resonator pattern 78.

In the example of the structure shown in FIG. 8C, a circular resonator pattern 81 is formed on the surface of a base substrate 80. Feeders 82 and 83 are coupled to the resonator pattern 81. An additional substrate 84 is disposed on the base substrate 80, and a circular additional pattern 85 is formed on the surface of the additional substrate 84. The feeders 82 and 83 and additional pattern 85 are disposed at positions corresponding to those of the feeders 76 and 77 and notch 79 shown in FIG. 8B.

Also in the superconductive filters having the resonator patterns shown in FIGS. 8A to 8C instead of the resonator patterns of the superconductive filters of the first and second embodiments, the center frequency can be shifted by adjusting the attitude of the adjustment substrate 20, while a change in the waveforms of the transmission and reflection characteristics is suppressed.

The resonator patterns of the superconductive filters of the first and second embodiments and the resonator pattern shown in FIG. 8C do not have a curved portion having a small curvature of radius and a sharp corner. If curved portions or sharp corners are formed, current concentrates upon the curved portion or sharp corner, and the superconductive phase may not be maintained because of heat generation or the like. The resonator patterns of the superconductive filters of the first and second embodiments and the resonator pattern shown in FIG. 8C can suppress local current concentration so that these resonator patterns are suitable for high power filters.

Figure 9A:
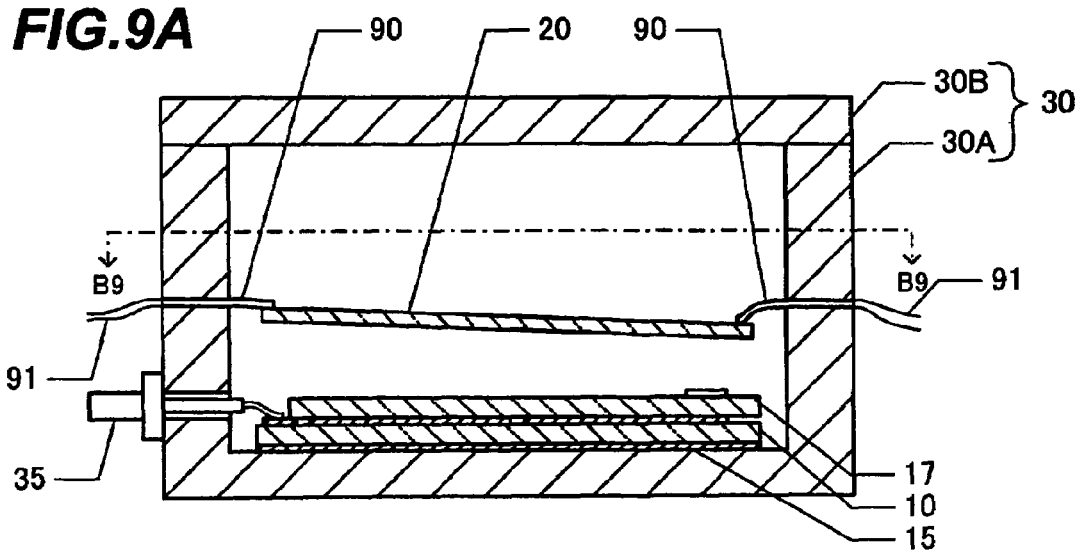
FIG. 9A is a plan view of a superconductive filter according to a third embodiment.
Figure 9B:
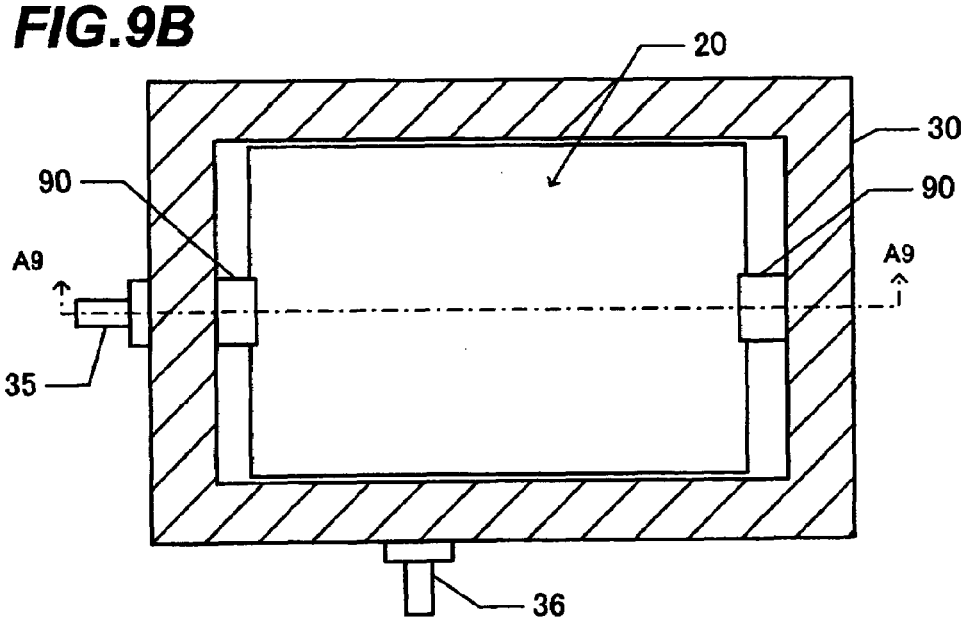
FIG. 9B is a cross sectional view thereof taken along one-dot chain line B9-B9 shown in FIG. 9A.

With reference to FIGS. 9A, 9B; 10A, 10B; 11, description will be made on a superconductive filter according to the third embodiment.

FIG. 9A is a cross sectional view of the superconductive filter of the third embodiment, and FIG. 9B is a cross sectional view taken along one-dot chain line B9-B9 shown in FIG. 9A. A cross sectional view taken along one-dot chain line A9-A9 shown in FIG. 9B corresponds to the cross sectional view shown in FIG. 9A. Description will be made by paying attention to different points from the superconductive filter of the first embodiment shown in FIGS. 1A to 1C, and it is omitted to describe the components having the same structure as that of the superconductive filter of the first embodiment.

In the first embodiment, the adjustment substrate 20 is supported by the support shaft 21, whereas in the third embodiment, the adjustment substrate 20 is supported by two piezoelectric thin film actuators 90 at generally the center positions of a pair of mutually parallel sides of the adjustment substrate 20. A base portion of the piezoelectric thin film actuator 90 is fixed to the package main body 30A, and a flexible potion of the actuator protrudes from the inner surface of the package main body 30A into the inside space of the package 30 like a beam. Lead wires 91 extend to the outside of the package 30 to apply a voltage to the piezoelectric thin film actuator 90. A distal end of the flexible portion of the piezoelectric thin film actuator 90 is fixed to the adjustment substrate 20. The attitude of the adjustment substrate 20 can be changed by changing the deflection degree of the flexible portion.

Figure 10A:
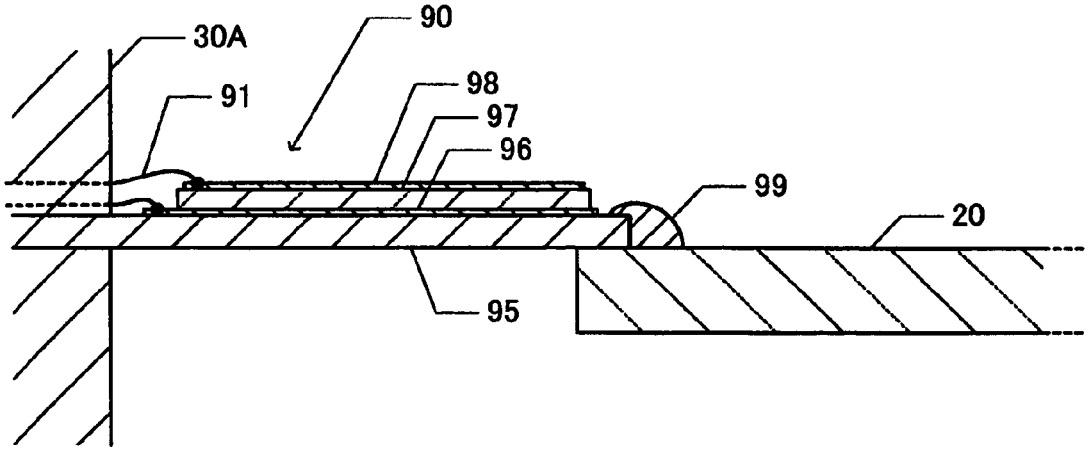
FIGS. 10A and 10B are a cross sectional view and a plan view, respectively, of an actuator used for the superconductive filter of the third embodiment.
Figure 10B:
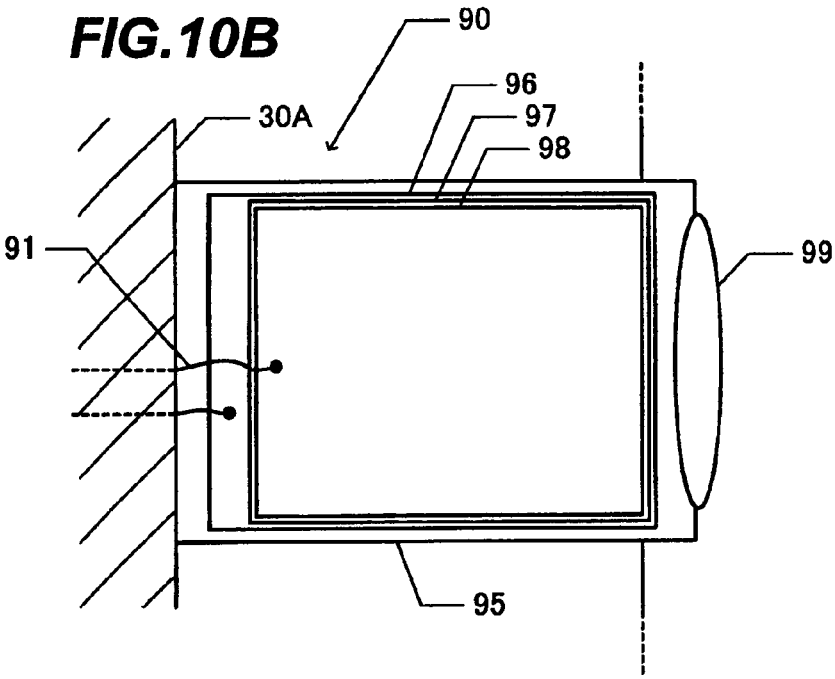

FIGS. 10A and 10B are respectively a cross sectional view and a plan view of the piezoelectric thin film actuator 90. The piezoelectric thin film actuator 90 is constituted of a stainless steel substrate 95, a lower electrode 96, a piezoelectric film 97 and an upper electrode 98. The lower electrode 96, the piezoelectric film 97 and the upper electrode 98 are laminated on the surface of the flexible portion. A thickness of the substrate 95 is 10 μm for example.

The lower electrode 96 is made of refractory metal such as platinum (Pt), conductive nitride such as TiN, conductive oxide such as $SrRuO_3$ or the like, and a thickness thereof is 200 n m for example. These materials can be deposited on the substrate 95 by sputtering or a vacuum deposition method. The piezoelectric film 97 is made of piezoelectric material such as lead zirconate titanate (PZT) and lead lanthanum zirconate titanate (PLZT), and a thickness thereof is 2 to 3 μm for example. The piezoelectric film 97 can be formed by sputtering, a sol-gel method, a metal organic chemical vapor deposition (MOCVD) method, a pulse laser deposition (PLD) method, a hydrothermal synthesis method, an aerosol deposition (AD) method or the like. The upper electrode 98 as well as the lower electrode 96 is made of refractory metal such as platinum (Pt), conductive nitride such as TiN, conductive oxide such as $SrRuO_3$ or the like, and a thickness thereof is 200 nm for example.

Patterning the lower electrode 96, piezoelectric film 97 and upper electrode 98 can be achieved by lift-off, wet etching, dry etching or the like using a photoresist pattern. If a pattern size is large, a metal through mask may be used to form films.

The distal end of the flexible portion of the substrate 95 is fixed to the adjustment substrate 20 by solder 99. The lead wires 91 are connected to the lower electrode 96 and upper electrode 98, respectively, by wire bonding or the like. The lead wires 91 extend to the outside of the package in an electrically isolated state. A length of the flexible portion of the substrate 95 is 50 mm for example.

Instead of connecting the lead wires 91 to the lower electrode 96 and upper electrode 98 by wire bonding or the like, wiring patterns may be formed on the substrate to use them as the lead wires. In this case, an insulating film of alumina, silica or the like having a thickness of 300 nm is formed by sputtering, CVD or the like, covering the whole surface of the substrate (actuator), and wiring patterns are formed on the insulating film. The wiring patterns are connected to the lower electrode 96 and upper electrode 98 via openings formed in the insulating film.

As a dc voltage is applied between the lower electrode 96 and upper electrode 98, the flexible portion of the substrate 95 deflects. The deflection degree can be adjusted by changing amplitude of voltage.

Although a unimorph type actuator is shown in FIGS. 10A and 10B, a bimorph type actuator may also be used.

Figure 11:
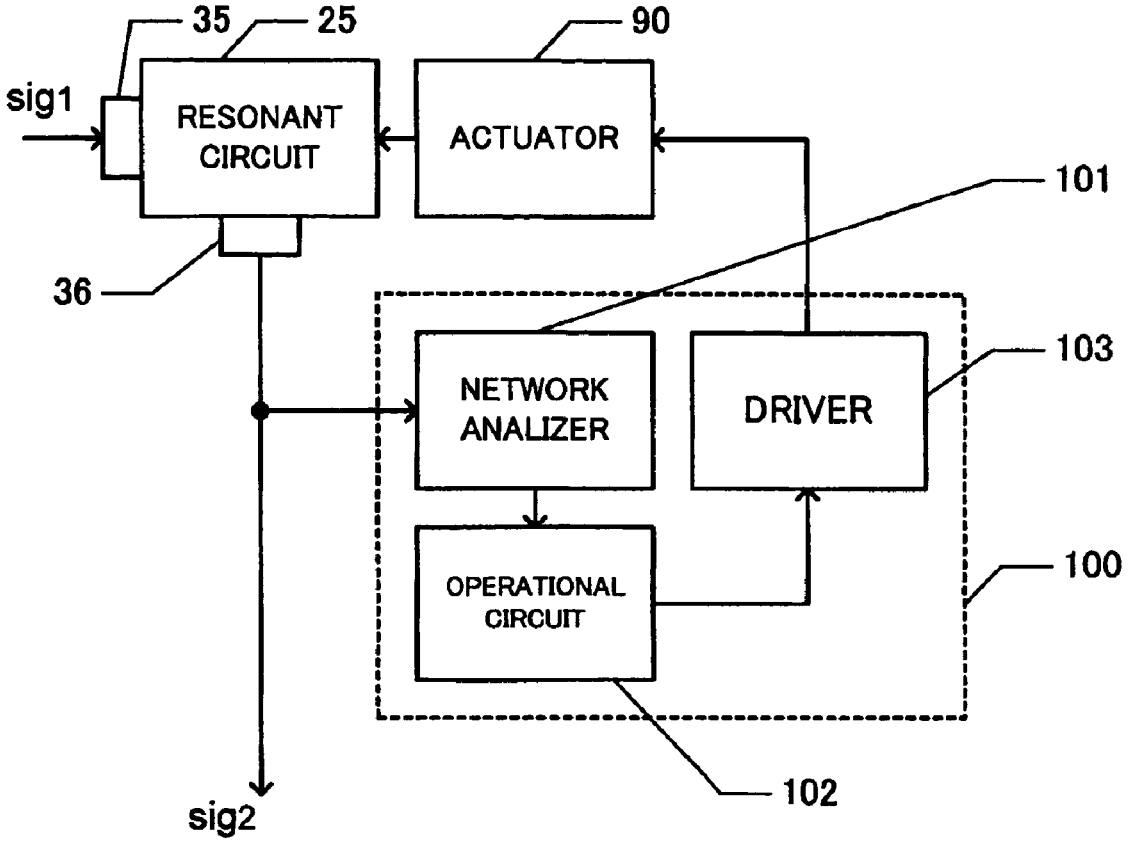
FIG. 11 is a block diagram showing a control system for the superconductive filter of the third embodiment.

FIG. 11 is a block diagram showing a control system for the superconductive filter of the third embodiment. An input signal sig1 is input to a resonant circuit 25 via an input connector 35. The resonant circuit 25 is constituted of the base substrate 10, feeders 11 and 12, resonator patterns 13 and 14, additional substrate 17 and additional pattern 18 shown in FIG. 2C, the ground line shown in FIG. 1A and the like. An output signal sig2 is output from an output connector 36.

A controller 100 includes a network analyzer 101, an operational circuit 102 and a driver 103. The output signal sig2 from the resonant circuit 25 is input to the network analyzer 101. The network analyzer 101 acquires a spectrum waveform (e.g., the waveform T1 in FIG. 3B, the waveform T2 in FIG. 4B or the waveform T3 in FIG. 5B) of the output signal sig2. This spectrum waveform is input to the operational circuit 102.

The operational circuit 102 compares the spectrum waveform of the output signal sig2 with the target standard waveform, and sends a control signal to the driver 103 to make the spectrum waveform of the output signal sig2 have a waveform like the target standard waveform. The driver 103 drives the actuator 90 in accordance with the control signal received from the operational circuit 102. This feedback control is repeated so that a stable filter characteristic can be obtained.

In the third embodiment, the adjustment substrate 20 is supported by two piezoelectric thin film actuators 90 at generally the center positions of a pair of mutually parallel sides of the adjustment substrate 20. Therefore, although the tilt angle in one direction can be changed, the tilt angle in a direction perpendicular to the one direction cannot be changed. Next, description will be made on examples capable of changing the tilt angle in two directions.

In the examples shown in FIGS. 12A to 12E, an adjustment substrate 20 has a plan shape including first and second sides 20*a* and 20*b* parallel to each other and third and fourth sides 20*c* and 20*d* perpendicular to the first side 20*a*.

Figure 12A:
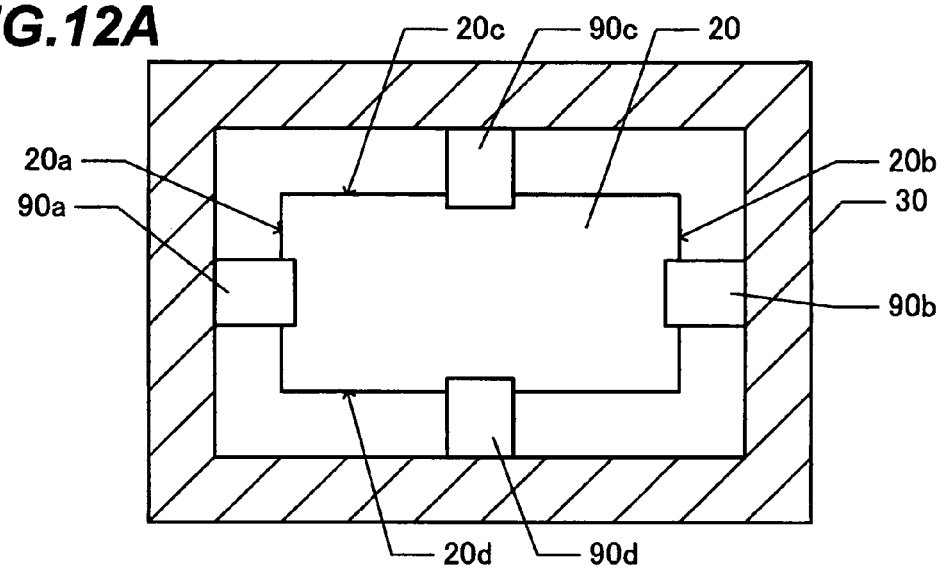
FIGS. 12A to 12E are cross sectional plan views showing other examples of the structure of the superconductive filter of the third embodiment.

As shown in FIG. 12A, four actuators 90*a*, 90*b*, 90*c*, 90*d* are mounted at generally the centers of the first to fourth sides 20*a*, 20*b*, 20*c*, 20*d*. By supporting the adjustment substrate 20 by four actuators 90*a* to 90*d*, the tilt angle can be changed in two directions.

Figure 12B:
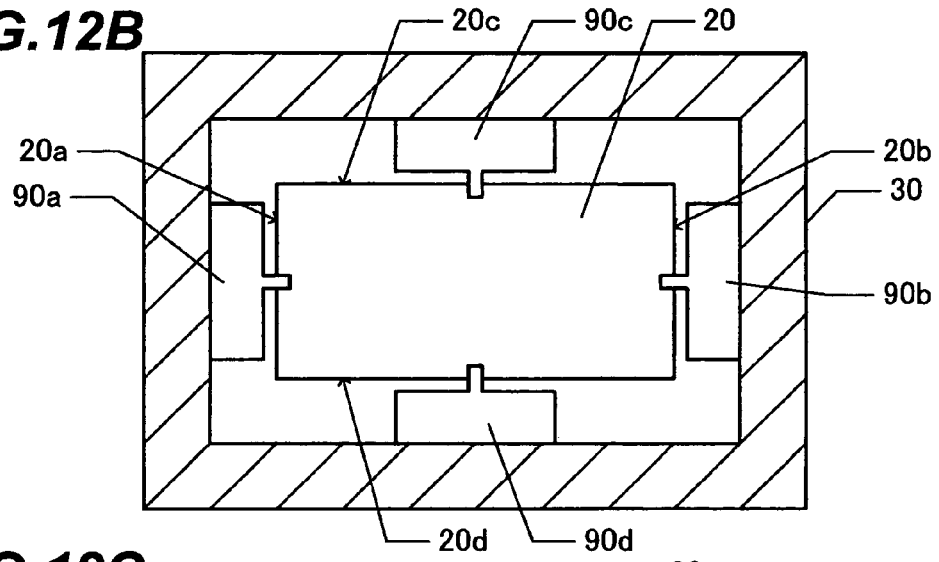

In the example shown in FIG. 12B, a width of each of four actuators 90*a* to 90*d* is wider than that shown in FIG. 12A. The top end portion mounted on the adjustment substrate 20 is narrower than the other portion. Since the width of each of the actuators 90*a* to 90*d* is made wider, a large drive force can be generated. By narrowing the top end portion mounted on the adjustment substrate 20, the attitude of the adjustment substrate 20 can be changed easily.

Figure 12C:
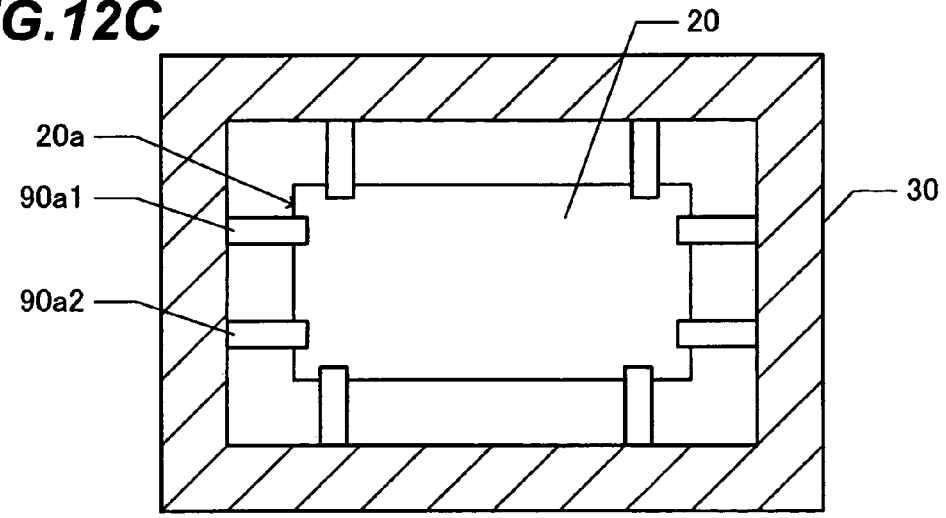

In the example shown in FIG. 12C, two actuators are mounted on each side of the adjustment substrate 20. For example, actuators 90*a*1 and 90*a*2 are mounted on the first side 20*a* at positions symmetrical with respect to the center of the side. By increasing the number of actuators 90, the attitude can be controlled more stably.

Figure 12D:
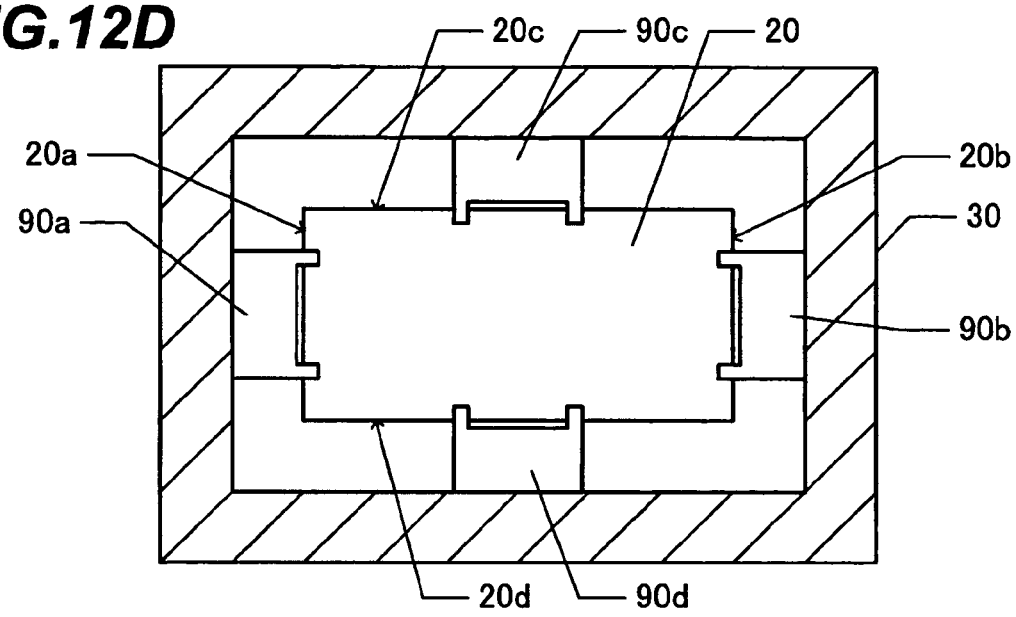

In the example shown in FIG. 12D, each of actuators 90*a* to 90*d* is mounted on the adjustment substrate 20 only at opposite ends in a width direction of the actuators 90*a* and 90*d*, and the central portion does not contact the adjustment substrate 20. With this arrangement, the attitude of the adjustment substrate 20 can be changed easily.

Figure 12E:
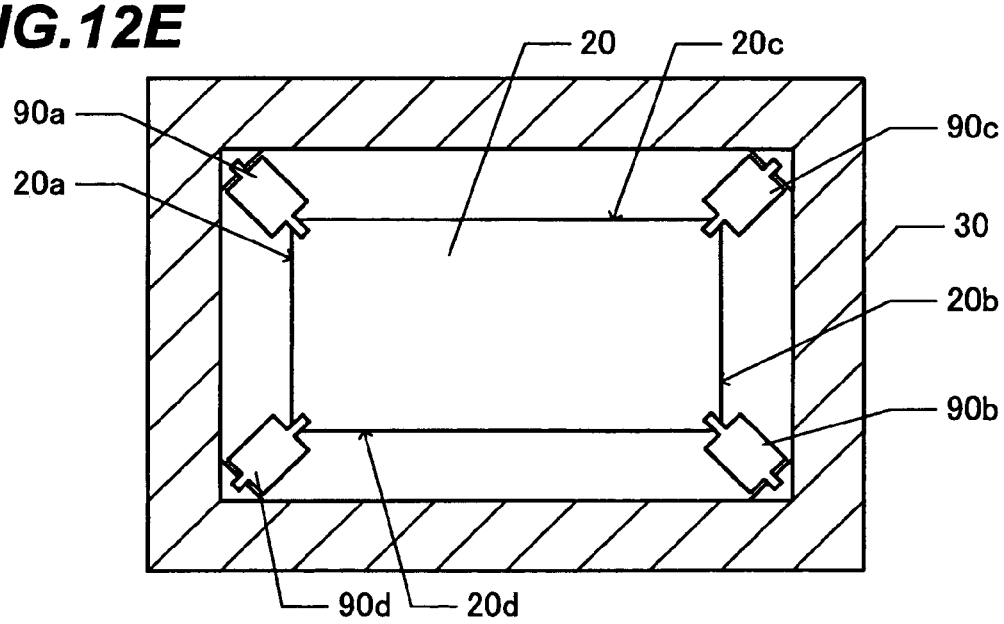

In the example shown in FIG. 12E, a planar shape of the adjustment substrate 20 is a square or a rectangle, and actuators 90*a*, 90*b*, 90*c*, 90*d* support the adjustment substrate 20*a* at its four corners. Also with this arrangement supporting the adjustment substrate 20 at four corners, the tilt angle of the adjustment substrate 20 can be changed in two directions.

The present invention has been described in connection with the preferred embodiments. The invention is not limited only to the above embodiments. It will be apparent to those skilled in the art that other various modifications, improvements, combinations, and the like can be made.

What are claimed are:

1. A method of adjusting filter characteristic of a superconductive filter comprising:

a base substrate made of dielectric material;

a resonator pattern made of superconductive material and formed over a first surface of the base substrate;

an adjustment substrate made of dielectric material and disposed facing the first surface at a distance from the first surface;

a package configured to accommodate the base substrate and the adjustment substrate; and a support shaft of dielectric material having a dielectric constant lower than a dielectric constant of the dielectric material of the adjustment substrate, the support shaft being fixed to a surface of the adjustment substrate opposite to a surface facing the base substrate, and at least one end of the support shaft protruding from the package via a through hole disposed in a wall of the package, wherein the method comprises:

changing an attitude of the adjustment substrate with reference to the first surface of the base substrate, and wherein the changing the attitude of the adjustment substrate changes an angle between the first surface and a surface of the adjustment substrate facing the base substrate.

2. A superconductive filter comprising:

a base substrate of dielectric material;

a resonator pattern of superconductive material and disposed over a first surface of the base substrate;

an adjustment substrate of dielectric material and disposed facing the first surface at a distance from the first surface;

a supporter configured to support the adjustment substrate in such a manner capable of changing an angle between the first surface and a surface of the adjustment substrate facing the base substrate; and a package configured to accommodate the base substrate and the adjustment substrate, wherein:

the supporter comprises a support shaft of dielectric material having a dielectric constant lower than a dielectric constant of the dielectric material of the adjustment substrate;

the support shaft is fixed to a surface of the adjustment substrate opposite to a surface facing the base substrate; and at least one end of the support shaft protrudes from the package via a through hole disposed in a wall of the package.

3. The superconductive filter according to claim 2, wherein the supporter can translate the adjustment substrate in such a manner capable of changing a distance between the first surface and the adjustment substrate.

4. The superconductive filter according to claim 2, wherein an inner circumferential surface comprises a guide surface extending in a direction perpendicular to the first surface, and the support shaft is guided by the guide surface and moves in the direction perpendicular to the first surface.

5. A superconductive filter comprising:

a base substrate of dielectric material;

a resonator pattern made of superconductive material and disposed over a first surface of the base substrate;

an adjustment substrate of dielectric material and disposed facing the first surface at a distance from the first surface; and a supporter configured to support the adjustment substrate in such a manner capable of changing an angle between the first surface and a surface of the adjustment substrate facing the base substrate, wherein the supporter comprises first and second actuators supporting the adjustment substrate at different positions, each of the first and second actuators has a lamination structure including a piezoelectric film, and an attitude of the adjustment substrate is changed by changing a deflection degree of the lamination structure.

6. The superconductive filter according to claim 5, wherein a planar shape of the adjustment substrate is a square or a rectangle, and the supporter further comprises third and fourth actuators, and wherein the first, second, third and fourth actuators support the adjustment substrate at four corners of the adjustment substrate, respectively.

7. The superconductive filter according to claim 5, wherein an output signal from the resonator pattern is input to a controller and each of the first and second actuators is controlled by the controller in such a manner that a spectrum waveform of the output signal approaches a target waveform.

8. The superconductive filter according to claim 5, wherein the adjustment substrate has a planar shape including first and second sides parallel to each other and third and fourth sides perpendicular to the first side, and the first and second actuators support the adjustment substrate at positions corresponding to the first and second sides.

9. The superconductive filter according to claim 8, wherein the supporter further comprises third and fourth actuators which support the adjustment substrate at positions corresponding to the third and fourth sides.

* * * * *